US008732932B2

(12) United States Patent
Laforest

(10) Patent No.: US 8,732,932 B2
(45) Date of Patent: May 27, 2014

(54) METHOD AND SYSTEM FOR TREATING FLOORBOARDS

(75) Inventor: Earl Laforest, Mirabel (CA)

(73) Assignee: Plancher Avant-Guard Inc., Ripon, Quebec (CA)

( * ) Notice: Subject to any disclaimer, the term of this patent is extended or adjusted under 35 U.S.C. 154(b) by 386 days.

(21) Appl. No.: 13/049,651

(22) Filed: Mar. 16, 2011

(65) Prior Publication Data

US 2012/0151732 A1 Jun. 21, 2012

(30) Foreign Application Priority Data

Dec. 21, 2010 (CA) ..... 2725683

(51) Int. Cl.
*B23P 19/02* (2006.01)

(52) U.S. Cl.
USPC ..... 29/426.4

(58) Field of Classification Search
USPC ..... 29/426.1, 426.3, 426.4, 428, 429, 458, 29/460, 466, 527.1, 527.2; 52/578, 730.7; 427/291, 440; 144/350, 360, 366
See application file for complete search history.

(56) References Cited

U.S. PATENT DOCUMENTS

| | | | | |
|---|---|---|---|---|
| 2,431,225 | A | 11/1947 | Belk | |
| 2002/0023702 | A1 | 2/2002 | Kettler | |
| 2002/0152714 | A1 | 10/2002 | Van Capelleveen | |
| 2004/0016197 | A1 * | 1/2004 | Ruhdorfer | 52/578 |
| 2006/0037270 | A1 | 2/2006 | Niese | |

FOREIGN PATENT DOCUMENTS

| | | |
|---|---|---|
| CA | 2664730 | 4/2009 |
| CA | 2664730 | * 10/2010 |
| EP | 2127807 | 12/2009 |

* cited by examiner

*Primary Examiner* — John C Hong
(74) *Attorney, Agent, or Firm* — Pauly, Devries, Smith & Deffner, LLC

(57) ABSTRACT

A method and system for treating floorboards. A plurality of panels are provided and comprise a plurality of floorboards, each floorboard having a top and bottom surface, and longitudinal and transversal edges. The floorboards are assembled together by at least one of their edges to form the panel. The panel is mechanically dismantled in order to expose each edge of each floorboard. A treatment product is applied to the peripheral edges of the floorboards. The method and system of the invention are particularly suitable for a mass production of floorboards on a production line. The method and system of the invention allow the edges of the boards to be treated separately, for example with a color or shade different than the top and bottom surfaces.

5 Claims, 3 Drawing Sheets

METHOD AND SYSTEM FOR TREATING FLOORBOARDS

This application claims the benefit of Canadian Patent Application No. 2,725,683 filed on Dec. 21, 2010, the contents of which are herein incorporated by reference.

FIELD OF THE INVENTION

The present invention relates to a method and a system for treating pieces of wood flooring, such as, but not limited to, hardwood floorboards, and particularly for treating peripheral edges thereof.

BACKGROUND OF THE INVENTION

Floorings may be made of hard wood floorboards or laminate panels made from a derived timber product, in particular a highly compressed medium or high-density fiberboard.

Floorings are generally made of elongated floorboards or boards, with a top decorative surface, a bottom opposite surface and peripheral edges In particular; the edges have a connecting profile for the purpose of connecting adjacent boards and form the flooring.

A treatment can be applied to the peripheral edges of each floorboard, for instance in order to prevent the penetration of moisture and bacteria, which can cause the boards to swell up or mould to appear.

Different methods in the field of floorboard treatment have been disclosed in U.S. Pat. No. 2,431,225 (BELK); US patent applications published under Nos. 2002/0023702 A1 (KETTLER), 2002/0152714 A1 (VAN CAPELLEVEEN), US 2006/0037270 A1 (NIESE) or European patent application published under No. EP 2 127 807 (DELLE VEDORE).

Whilst the top and bottom surfaces of boards are generally provided with a very stable and wear-resistant coating which is also largely moisture proof, the unprotected derived timber material is exposed at the edges which are usually cut and profiled. Moisture can therefore penetrate at this point and cause swelling in a floorboard because the derived timber material that is used is relatively hygroscopic.

Floorboards being generally hydroscopic, any change in the relative humidity of the surrounding atmosphere leads to a change in the boards' shape after installation i.e. shrink or swell, and a gap between the boards will appear, rendering these edges permanently visible.

Some board models have profiled tapered edges. Two adjacent boards will then form a groove along two connected edges. This groove is commonly named "micro-V" in the art of flooring.

The flooring will become unsightly when gaps and micro-Vs between the floorboards are particularly visible, in particular when the peripheral edges have a different color or shade than the top surfaces of the boards. This difference may be due to the fact that the edges have not been treated. Furthermore, the top surface may have its color fading with the passing of time, surface wear or both.

Although top surfaces and tapered edges of the boards are manufactured or treated with a same color and shade, a shadow effect will render the shade of the micro-V apparently darker than the shade of the top surface.

A solution to the problems described above would be to have the peripheral edges treated or dyed in a way to obtain a shade of the edges slightly lighter than the shade of the top surfaces. The shades will be selected by the manufacturer in order to have edges and surfaces appearing with a same shade, once the boards are assembled to form the flooring. And despite the shadow effect or the color fading of the top surfaces.

Boards with the above-described properties can be treated manually. However, this method is not economically profitable for a mass-production of boards, except in countries providing cheap labour.

SUMMARY OF THE INVENTION

The present invention allows resolving at least one of the problems mentioned above in that it concerns a new method and system for treating floorboards.

According to a first aspect, the invention concerns a method for treating elongated pieces of flooring. The method comprises the steps of:

a) providing a plurality of panels, each panel comprising a plurality of elongated pieces of flooring, each piece having an upper and a lower surface, two opposite longitudinal edges and two opposite transversal edges, said pieces being assembled together by at least one of their longitudinal and/or transversal edges to form the panel;
b) mechanically dismantling the panel in order to expose each edge of each elongated piece; and
c) applying a treatment product to the longitudinal and/or transversal edges of the elongated pieces.

As aforesaid, floorings are generally made of hard wood floorboards or laminate panels made from a derived timber product, in particular a highly compressed medium or high-density fiberboard. However, the method of the invention is not limited to the making of floorboards, and can be suitable to any kind of boards or panels made of any sorts of materials known in the art. For example, the method may be suitable for the treatment of any kind of elongated board used in construction, furniture, decorative boards, frames, beams or the like.

The method of the invention is particularly suitable for a mass-production of floorboards on a production-line, in that the panels of boards are firstly dismantled in order to expose the peripheral edges to be secondly treated. The edges can be then treated separately from the top and/or bottom surfaces of the boards, allowing a treatment of the board edges different than the surfaces. For example, after step c), the method may further comprise the step d) of mechanically assembling the elongated pieces to form a reassembled panel for further treatment of the upper and/or lower surfaces of the elongated pieces.

In step c) of the method, the treatment product may be a first dye having a first shade of a color, whereas in step d), the treatment consists of applying to the upper surface of the pieces a second dye having a second shade of said color as in step c). Preferably, the second shade of the second dye applied to the surfaces in step d) is darker than the first shade of the first dye applied to the edges in step c), allowing edges and surfaces of the boards to appear having the same shade once the boards are assembled to form the flooring.

In the particular case of a mass-production line of the boards, the method of the invention may further comprise, before step a), a step of mechanically dismantling a stack comprising a plurality of layered panels, each being made of a plurality of elongated pieces of wood flooring. This step allows providing the plurality of panels that are then dismantled.

In step c), the treatment product may be applied simultaneously to the longitudinal and transversal edges of each elongated piece. This treatment product may include varnishes, paints, dyes, or the like. These products may comprise ant-moisture and anti-fungi compounds allowing a better protection of the flooring.

In step c) of the method, the treatment product may be applied using rolls or sprays. More preferably, the product is applied using several directional sprays or guns, located above the passage of the boards, pointing in the direction of the transversal or longitudinal edges.

According to a second aspect, the invention concerns a system for treating elongated pieces of wood flooring. The system comprises:

- a first conveyer for conveying panels, each panel being made of several elongated pieces of wood flooring, each piece having an upper and a lower surface, two opposite longitudinal edges and two opposite transversal edges, said pieces being assembled together by at least one of their longitudinal and/or transversal edges to form the panel;
  - a dismantling device for dismantling the panels along a longitudinal axis into separated pieces while the pieces are transversally conveyed on the first conveyer;
  - a second conveyer for conveying the separated pieces perpendicularly with respect to the first conveyor, the second conveyer longitudinally conveying the separated pieces and maintaining a separation therebetween; and
  - a treating device for applying a treatment product to the longitudinal and/or transversal edges of said elongated pieces while the pieces are longitudinally conveyed on the second conveyer.

The first conveyer of the system may comprise a plurality of parallel rotating chains in contact with the elongated pieces for transversally conveying the pieces.

Then, the second conveyer of the system may comprise a plurality of rotating cylinders. A first group of these rotating cylinders of the second conveyer is proximate the first conveyor, each cylinder of the first group being then located between two adjacent chains of the first conveyer.

These rotating cylinders are vertically movable between a lower position, wherein the pieces are in contact with the rotating chains of the first conveyer, and an upper position wherein the pieces are in contact with the rotating cylinders of the second conveyer, allowing the pieces to transfer from the first conveyer to the second conveyer.

The system of the invention may further comprise a third conveyer for conveying the pieces perpendicularly with respect to the second conveyer and for transversally conveying the pieces. The third conveyer may further have an assembling device for assembling the pieces conveyed on it, once treated, via their longitudinal edges and form as such a reassembled panel. The entire surface of the reassembled panel may be then treated, e.g. sanded, painted, dyed and/or varnished.

The third conveyer may comprise a plurality of parallel rotating belts, such as for the chains of the first conveyer. The second conveyer then comprises a second group of rotating cylinders in proximity of the third conveyer, each adjacent cylinders of the second group being located between two belts of the third conveyer. The rotating cylinders are also vertically movable between an upper position, wherein the pieces are in contact with the rotating cylinders of the second conveyer, and a lower position wherein the pieces are in contact with the rotating belts of the third conveyer, allowing the pieces to transfer from the second conveyer to the third conveyer.

The system of the invention may further comprise a second dismantling device for dismantling pieces that would have remained connected by at least one of their transversal edge, allowing as such the transversal edges to be also treated when conveyed on the second conveyer. Then, the system preferably further comprises an assembling device for assembling the pieces conveyed on the second conveyor, once treated, along their transversal edges.

Preferably, the treating device of the system comprises a plurality of directional spraying guns. Each gun is adapted to spray an appropriate amount of the treatment product precisely to the longitudinal and/or transversal edges of each piece.

The invention and its advantages will be better understood upon reading the following description made with reference to the accompanying drawings.

DETAILED DESCRIPTION

As aforesaid, the present invention concerns a method and a system for treating pieces of wood flooring, such as hardwood floorboards, and particularly for treating peripheral edges thereof.

Figure 1:
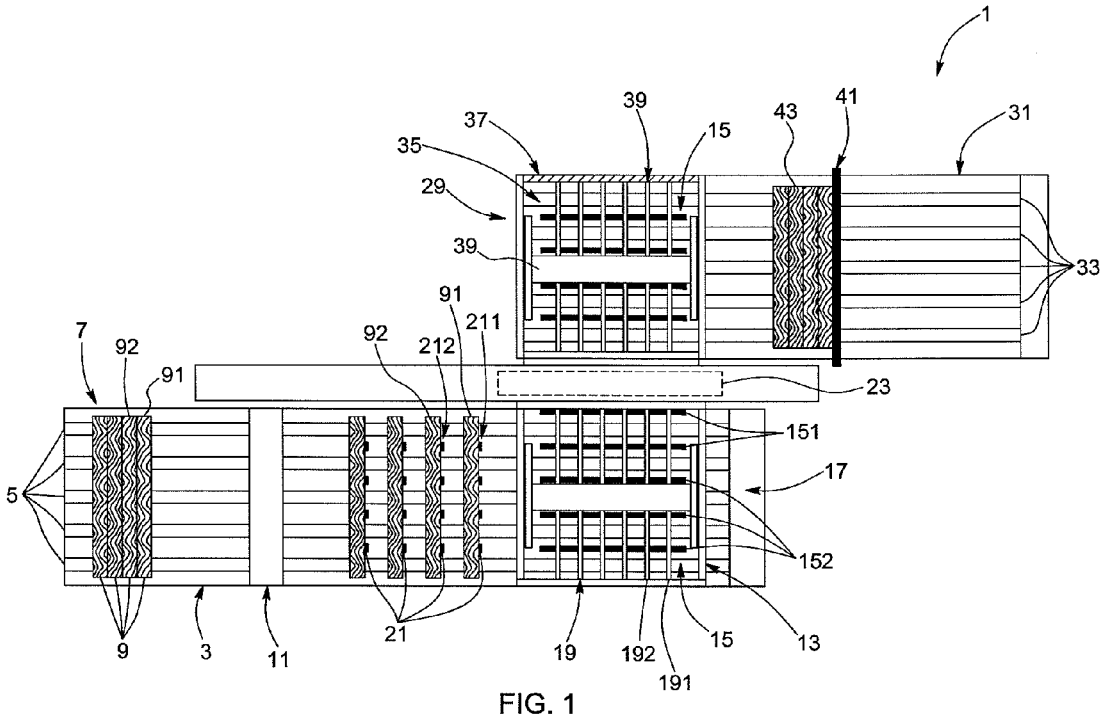
FIG. 1 is a top schematic view of the system for treating elongated pieces of wood flooring according to a preferred embodiment of the invention.
Figure 2A:
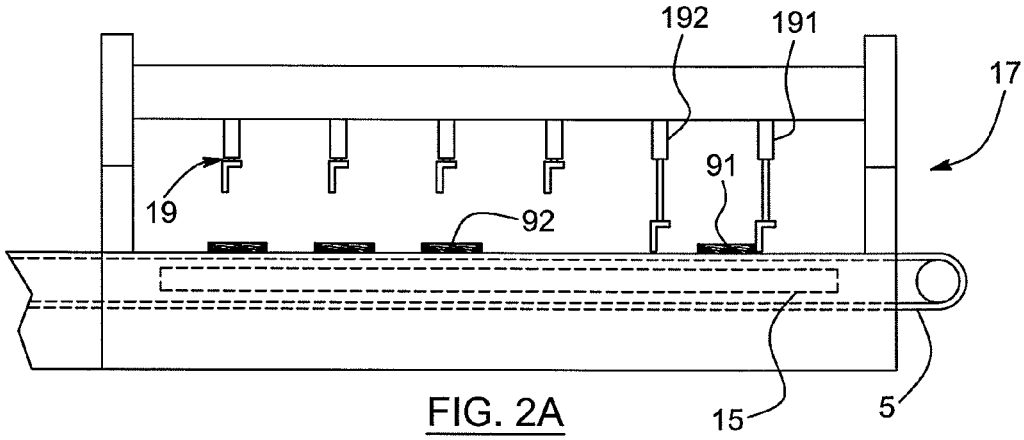
FIG. 2A to 2C are side views illustrating the transfer zone between the first and second conveyers of the system illustrated on FIG. 1.
Figure 2B:
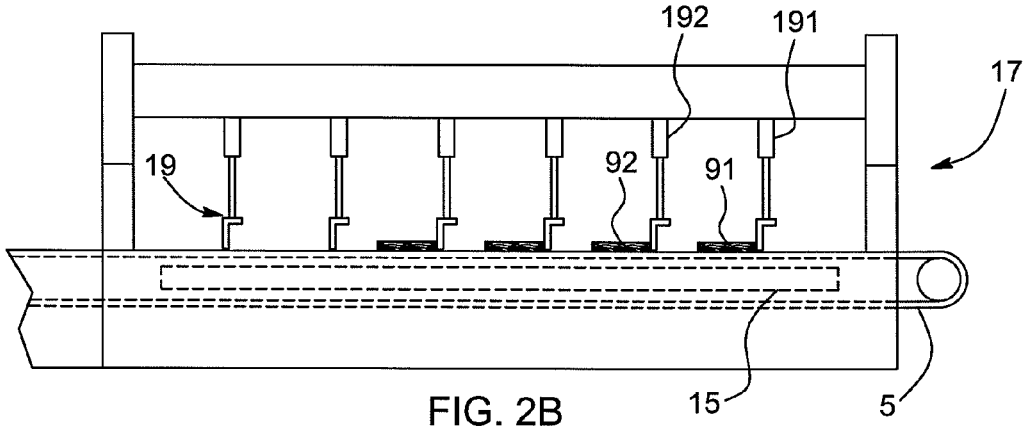
Figure 2C:
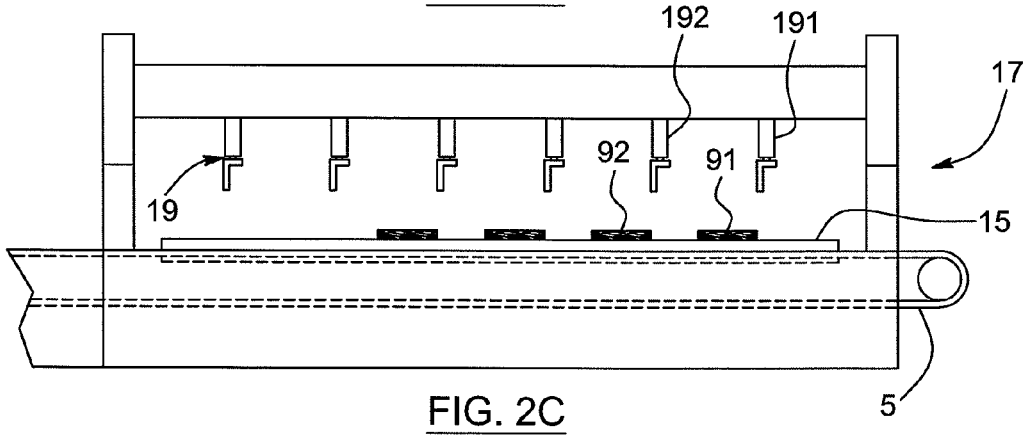
Figure 3:
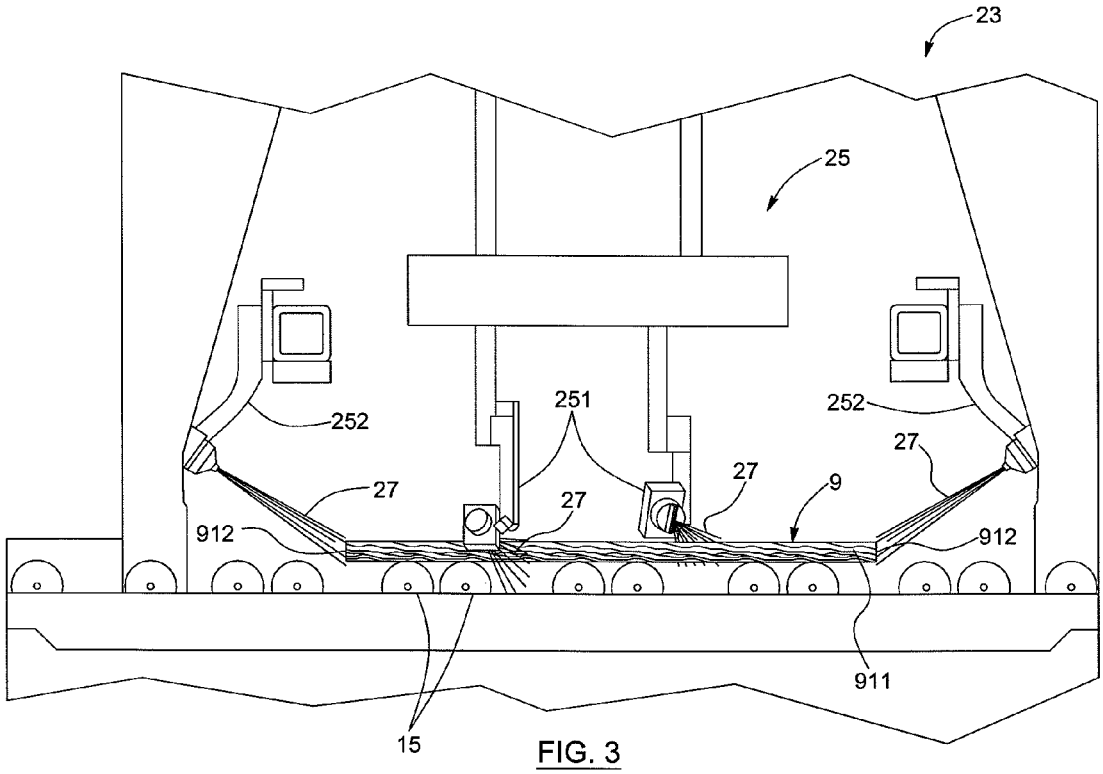
FIG. 3 is a side view of the treating section of the system illustrated on FIG. 1.

FIGS. 1 to 3 illustrate one preferred embodiment of the system according to the invention.

Referring to FIG. 1, there is shown a top schematic view of the system (1) for treating elongated pieces of wood flooring.

The system (1) as illustrated, is an automated treatment line including a first conveyer (3) comprising a plurality of parallel rotating chains or belts (5) for conveying floorboard panels (7).

Indeed, each floorboard panel (7) comprises several elongated pieces of wood flooring, hereafter named floorboards or boards (9). Each board (9) has two opposite longitudinal edges (911, FIG. 3) and two opposite transversal edges (912, FIG. 3). These edges (911, 912) are preferably pre-machined or pre-cut in order to be properly assembled to form the flooring.

The rotating chains (5) of the first conveyer (3) support and convey by friction the panel (7) which is first conveyed through a dismantling device (11), such as a panel breaker or the like. The panel (7) is thus dismantled into separated boards (9) along their longitudinal axis while the boards (9) are transversally conveyed on the first conveyer (3).

The system (1) also comprises a second conveyer (13) for conveying the separated boards (9) perpendicularly with respect to the first conveyor (3). As detailed hereinafter, the second conveyer (13) is adapted to longitudinally convey the boards (9) and maintain an adequate gap therebetween.

As illustrated on FIGS. 1 and 2, the second conveyer (13) comprises a plurality of rotating cylinders (15). A first group of these rotating cylinders (151, 152) of the second conveyer (13) is proximate the first conveyor (3), in a zone named hereinafter the "transfer zone" (17). In the transfer zone (17), each cylinder (15) is located between two adjacent chains (5) of the first conveyer (3).

As illustrated on FIG. 2A to 2C, these rotating cylinders (151, 152) are vertically movable between a lower position (FIGS. 2A and 2B), wherein the boards (9) are in contact with the rotating chains (5) of the first conveyer (3), and an upper position (FIG. 2C) wherein the boards (9) are now in contact with the rotating cylinders (151, 152) of the second conveyer (13). This movement between the lower and upper position of the rotating cylinders (151, 152) allows the boards (9) to transfer from the first conveyer (3) to the second conveyer (13), and also to change the movement of the boards from a lateral movement when the boards are on the first conveyer (3), and a longitudinal movement when the boards (9) are on the second conveyer (13). As detailed hereinafter, a longitudinal movement of the boards on the second conveyer (13) allows an easier treatment of the edges according to step c) of the method.

Step b) of the method according to the present invention allows the edges of the boards to be exposed for treatment. For doing so, the boards are separated and maintained in a parallel position in order to form a gap therebetween.

As illustrated on FIGS. 1 and 2A to 2C, the transfer zone (17) also comprises a series of vertically movable stoppers (19). The stoppers in their lower position (FIG. 2B) retain the boards in a parallel position before to be transferred on the second conveyer (13).

As illustrated on FIG. 2A, the stoppers (19) are programmed to lower and then block the boards (9) one after the other (191, 192), while the boards (9) are moving into the transfer zone (17).

In order to have the boards (9) entering the transfer zone (17) separately, they are previously settled in a parallel position (FIG. 1) thanks to a plurality of movable blockers (21) located between the dismantling device (11) and the transfer zone (17). The blockers (21) are movably mounted between the rotating chains (5) of the first conveyer (3). As for the stoppers, a first series of blockers (211) automatically blocks the first board (91) coming from the dismantling device (11). After the passage of the first board (91), a second series of blockers (212) located between the dismantling device (11) and the first series of blockers (211), arise between the rotating chains (5) in order to block the second board (92) in a parallel position to the first board (91). It is understood that the number of stoppers and blockers may vary depending on the number of boards (9) to be treated by the system (1).

After that, all the boards (9, 91, 92) having been settled in a parallel position, the first series of blockers (211) moves in order to release the first board (91), allowing it to move first into the transfer zone (17) until it reaches and is blocked by the first stoppers (191) settled down in their lower position. Meanwhile, the second series of blockers (212) release the second board (92), allowing it to move into the transfer zone (17) after the first board (91), until it reaches and is blocked by the second stoppers (192) that have moved down in their lower position right after the passage of the first board (91). The same sequence occurs for the others boards until all the boards are blocked and settled in a parallel position in the transfer zone (FIG. 2B).

The transfer of the boards (9) from the first (3) to the second conveyer (13) in the transfer zone (17) corresponds to a sequenced upwards movement of the rotating cylinders (15) and stoppers (19) from their lower position (FIG. 2B) to their upper position (FIG. 2C).

Referring to FIGS. 1 and 3, the boards (9), after their transfer, move forward into a treating section (23) of the system (1), wherein step c) of the method is performed, i.e. a treatment product is applied to the longitudinal (911) and/or transversal (912) edges of the boards while the boards (9) are longitudinally conveyed on the second conveyer (13).

The longitudinal floorboards (9) may be formed of a plurality of shorter board pieces assembled by their transversal edges (912). In that case, these shorter pieces have to be preferably separated before entering the treating section (23), allowing as such the transversal edges (912) of each board pieces to be also treated. Therefore, according to another preferred embodiment of the invention, the system (1) may comprises a second dismantling device for dismantling these board pieces that remain connected by at least one of their transversal edges.

Referring to FIG. 1, a first manner to transversally dismantle the boards consists in having the rotating cylinders (151) of the transfer zone (17) being close to the treating section (23) and programmed for a higher speed of rotation than the other rotating cylinders (152) located at the beginning of the second conveyer (13), i.e. far from the treating section. Consequently, the pieces of the boards (9) close to the treating section (23) separate from the rest of each board and move first into the treating section.

The separation of the shorter pieces may also be done by having the rotating cylinders (151) close to the treating section (23) programmed for having a higher rotating speed than the other rotating cylinders (152).

According to another preferred embodiment of the invention illustrated on FIG. 3, the treating section (23) comprises a treating device (25) including several directional spraying guns (251, 252). Some guns (251) are positioned to spray an appropriate amount of at least one treatment product (27) precisely to the longitudinal edges (911) of each board (9), whereas other guns (252) are positioned to spray another appropriate amount of a treatment product (27) precisely to the transversal edges (912). Preferably, the treatment is performed while the boards (9) are moving forward on the second conveyor (13).

As also illustrated on FIG. 1, the boards (9), after being treated, move into a second transfer zone (29) between the second conveyer (13) and a third conveyer (31).

The third conveyer (31) allows conveying of the boards (9) perpendicularly with respect to the second conveyer (13) and for transversally conveying them. As for the first conveyer (3), the third conveyer (31) comprises a plurality of parallel rotating chains or belts (33).

As for the first transfer zone (17), the second conveyer (13) of the second transfer zone (29) comprises a second group of rotating cylinders (35) in proximity of the third conveyer (31), each adjacent cylinder (35) of the second group being located between two adjacent belts (33) of the third conveyer (31). The rotating cylinders (35) are also vertically movable between an upper position, wherein the boards (9) are in contact with the rotating cylinders (35) of the second conveyer (13), and a lower position wherein the boards are in contact with the rotating belts (33) of the third conveyer (31), allowing the boards to transfer from the second conveyer (13) to the third conveyer (31).

Before being transferred from the second to third conveyer (13, 31), the smaller pieces constituting each board are reassembled in the second transfer zone (29) by entering into contact with an abutting device (37) located at the end of the second conveyer (13), reforming as such each elongated board (9).

In order to reform a quite perfect elongated board (9), it is preferable to guide the smaller pieces thanks to a second series of stoppers or guides (39) that may be identical to the stoppers (19) of the first transfer zone (17). The transfer of the boards (9) from the second to the third conveyer (13, 31) within the second transfer zone (29) corresponds to a sequential downwards movement of firstly the rotating cylinders (35) and secondly the guides (39) from their lower position to their upper position. The smaller pieces abutting the abutting device (37), while being on the second conveyer, allow the transversal edges of the pieces to reconnect and reform each board (9). Then, the boards (9) abutting the stoppers or guides (39), while being on the second conveyer, allow each board (9) to align and reform an elongated board (9).

Then, the stoppers or guides (39) move upwards and the boards are conveyed on the third conveyer (31) to move out the second transfer zone (29) in a lateral movement.

The third conveyer (31) preferably includes an assembling device (41) for assembling the boards (9) conveyed on it. The boards moving out of the second transfer zone abut the assembling device (41), reassemble via their longitudinal edges and reform as such a reassembled panel (43).

The entire surface of the reassembled panel (43) may then be further treated, e.g. sanded, painted, dyed and/or varnished. The treatment of the surface may commence after transferring the re-assembled elongated pieces from conveyor (31) to another perpendicular conveyor.

It is to be understood that the above example is a schematic view of the system invented by the inventors. The materials to make each piece of the system, the pieces themselves and their movement, involve material, assembling and engineering techniques of the art. Each piece of the systems, their speed, movement, amount of treatment product spread, can be controlled using computer, electronic, optic and/or robotic technologies. The treatment products applied on the boards are also those well known in the art.

The system and method of the invention allows a mass production of treated boards, wherein the edges of the boards can receive a different treatment than their surfaces.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A method for treating elongated pieces of flooring, said method comprising:

a. providing a plurality of panels, each panel comprising a plurality of elongated pieces of flooring, each piece having an upper and a lower surface, two opposite longitudinal edges and two opposite transversal edges, said pieces being assembled together by at least one of their longitudinal and/or transversal edges to form said panel;

b. mechanically dismantling the panel in order to expose each edge of each elongated piece;

c. applying a first treatment product selected from the group consisting of varnishes, paints, and dyes, having a first shade of a color to the longitudinal and/or transversal edges of said elongated pieces; and d. mechanically assembling said elongated pieces to form a reassembled panel; and e. treating the upper surfaces, lower surfaces, or both upper and lower surfaces of the elongated pieces with a second treatment product having a second shade of color.

2. The method of claim 1, wherein the second shade of the second treatment product is darker than the first shade of the first treatment product.

3. The method of claim 1, further comprising mechanically dismantling a stack comprising a plurality of layered panels each made of several elongated pieces of flooring, in order to provide said plurality of panels.

4. The method of claim 1, wherein said first treatment product is applied simultaneously to the longitudinal and transversal edges of each elongated piece.

5. The method of claim 1, wherein the first and second treatment products are applied by spray.

* * * * *